US009508303B2

(12) United States Patent
Kim et al.

(10) Patent No.: US 9,508,303 B2
(45) Date of Patent: Nov. 29, 2016

(54) DISPLAY DEVICE

(71) Applicant: Samsung Display Co., Ltd., Yongin, Gyeonggi-Do (KR)

(72) Inventors: Ock Jin Kim, Hwaseong-si (KR); Byeong-Soo Kang, Yongin-si (KR); Man Sung Kim, Suwon-si (KR); Sang-Moon Moh, Hwaseong-si (KR)

(73) Assignee: Samsung Display Co., Ltd., Gyeonggi-do (KR)

( * ) Notice: Subject to any disclaimer, the term of this patent is extended or adjusted under 35 U.S.C. 154(b) by 376 days.

(21) Appl. No.: 14/167,826

(22) Filed: Jan. 29, 2014

(65) Prior Publication Data

US 2014/0354620 A1 Dec. 4, 2014

(30) Foreign Application Priority Data

May 30, 2013 (KR) ..... 10-2013-0061988

(51) Int. Cl.
*G09G 5/00* (2006.01)
*G09G 3/36* (2006.01)

(52) U.S. Cl.
CPC ..... *G09G 3/3696* (2013.01)

(58) Field of Classification Search
None
See application file for complete search history.

(56) References Cited

U.S. PATENT DOCUMENTS

| | | | | |
|---|---|---|---|---|
| 7,742,023 | B2 | 6/2010 | Matsumoto | |
| 7,821,340 | B2 | 10/2010 | Lin et al. | |
| 2008/0218459 | A1* | 9/2008 | Kim | G02F 1/1323 345/87 |
| 2009/0294771 | A1 | 12/2009 | Kim et al. | |
| 2011/0175892 | A1 | 7/2011 | Lee et al. | |
| 2011/0193844 | A1 | 8/2011 | Lee et al. | |
| 2011/0234560 | A1 | 9/2011 | Shin et al. | |
| 2012/0013817 | A1 | 1/2012 | Kim et al. | |
| 2012/0249244 | A1 | 10/2012 | Chen et al. | |
| 2014/0028535 | A1* | 1/2014 | Min | G09G 3/18 345/87 |

FOREIGN PATENT DOCUMENTS

| | | | |
|---|---|---|---|
| KR | 10-2005-0032279 | A | 4/2005 |
| KR | 10-2008-0001255 | A | 1/2008 |

* cited by examiner

*Primary Examiner* — Adam R Giesy
(74) *Attorney, Agent, or Firm* — Knobbe, Martens, Olson & Bear, LLP

(57) ABSTRACT

A display device including voltage lines to transfer a power voltage is disclosed. One inventive aspect includes a display panel, a data driver formed on the display panel, a printed circuit board supplying a voltage to the data driver, and voltage lines connecting the data driver to the printed circuit board. The voltage lines further includes a first voltage line transferring a first power voltage, a second voltage line transferring the first power voltage or a second power voltage, a third voltage line transferring the second power voltage or a third power voltage, and a fourth voltage line transferring the third power voltage.

18 Claims, 6 Drawing Sheets

DISPLAY DEVICE

CROSS-REFERENCE TO RELATED APPLICATIONS

This application claims priority to and the benefit of Korean Patent Application No. 10-2013-0061988 filed in the Korean Intellectual Property Office on May 30, 2013, the entire contents of which are incorporated herein by reference.

BACKGROUND

Field

The disclosed technology generally relates to a display device including a voltage line to transfer a power voltage.

Description of the Related Technology

Liquid crystal displays (LCDs) are among the most common types of flat panel displays in use today, other related display technologies include organic light emitting diode displays (OLEDs), plasma displays, electrophoretic displays, etc. An LCD generally includes two sheets of display panels with field generating electrodes (e.g., a pixel electrode, a common electrode) and a liquid crystal layer interposed therebetween. The LCD generates an electric field in the liquid crystal layer by applying a voltage to the field generating electrodes and controls the direction of liquid crystal molecules of the liquid crystal layer. As a result, the polarization of incident light is controlled for displaying images.

In general, the display device (or display panel) includes pixels for displaying an image, and drivers for driving the pixels. The drivers include a data driver applying data signals to the pixels and a gate driver applying gate signals to the pixels. The gate signals control the transfer of the data signals.

The data driver receives voltage signals from an external source in order to generate the data signals and voltage lines are connected to the data driver for transfer of the voltage signals to the data driver.

For example, in order to generate data signals, at least two sets of voltage signals are typically used. In one case, two voltage signals are supplied and in another case, three voltage signals are supplied. As such, if two separate sets of wires are designed for these two cases, design cost and mask cost will increase.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE ASPECTS

Embodiments of the disclosed technology include a display device having a voltage line which can transfer a power voltage, for example Full-AVDD or another voltage, for example Half-AVDD.

Further, the disclosed technology includes a display device. One inventive aspect of the display device includes the voltage lines having reduced wire resistance.

An exemplary embodiment of the disclosed technology includes a display device. The display device further includes a display panel, a data driver formed on the display panel, a printed circuit board supplying a voltage to the data driver, and a plurality of voltage lines connecting the data driver and the printed circuit board, in which the plurality of voltage lines includes a first voltage line transferring a first power voltage, a second voltage line transferring the first power voltage or a second power voltage lower than the first power voltage, a third voltage line transferring the second power voltage or a third power voltage lower than the second power voltage, and a fourth voltage line transferring the third power voltage.

When the second voltage line transfers the first power voltage, the third voltage line transfers the third power voltage.

When the second voltage line transfers the second power voltage, the third voltage line transfers the second power voltage.

A width of the first voltage line and a width of the fourth voltage line are equal to each other.

the width of the first voltage line is equal to a sum of a width of the second voltage line and a width of the third voltage line.

The width of the second voltage line and the width of the third voltage line are equal to each other.

The first power voltage is two times larger than the second power voltage, and the third power voltage is a ground voltage.

The data driver may include a plurality of data driving ICs, and the voltage lines may connect the data driving ICs and the printed circuit board.

The voltage lines may include a plurality of first voltage lines, a plurality of second voltage lines, a plurality of third voltage lines, and a plurality of fourth voltage lines, and the first voltage lines, the second voltage lines, the third voltage lines, and the fourth voltage lines may connect the data driving ICs with the printed circuit board by a point-to-point method.

The voltage lines further include a fifth voltage line transferring a fourth power voltage, and a sixth voltage line transferring a fifth power voltage, in which the fifth voltage line and the sixth voltage line may connect the data driving ICs with the printed circuit board by a cascade method.

The first voltage line, the second voltage line, the third voltage line, and the fourth voltage line transfers analog power voltages, and the fifth voltage line and the sixth voltage line transfers logic power voltages.

The display device further includes a connecting member fixing the printed circuit board to the display panel, in which the connecting member is made of film on glass (FOG).

The display device further includes a gate driver formed on the display panel.

The second power voltage is a common voltage.

Magnitudes of the first power voltage and the third power voltage is the same as each other, and polarities thereof are opposite to each other.

The display device according to the exemplary embodiment of the disclosed technology as described above has the following effects.

In the display device according to the exemplary embodiment of the disclosed technology, the second voltage line transfers the first power voltage or the second power voltage and the third voltage line transfers the second power voltage or the third power voltage, and as a result, a required voltage is selected and used.

When the second power voltage is not used, the second voltage line is used to transfer the first power voltage and the third voltage line is used to transfer the third power voltage, and as a result, a wire resistance is decreased.

Another exemplary embodiment of the disclosed technology includes a display device. One inventive aspect of the display device comprises a display panel, a data driver formed on the display panel, a printed circuit board and voltage lines connecting the data driver to the printed circuit board. The printed circuit board is configured to supply voltages to the data driver.

DETAILED DESCRIPTION OF CERTAIN INVENTIVE EMBODIMENTS

Figure 1:
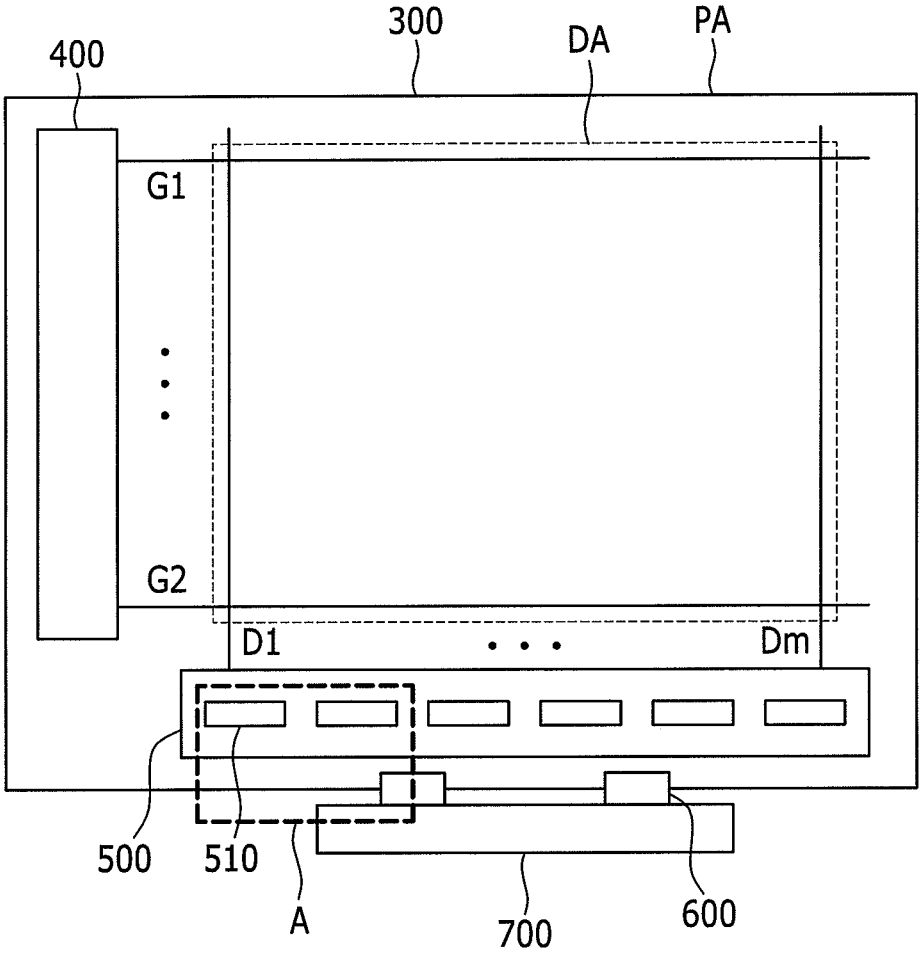
FIG. 1 is a block diagram illustrating a display device according to an exemplary embodiment of the disclosed technology.

The disclosed technology will be described more fully hereinafter with reference to the accompanying drawings, in which exemplary embodiments of the invention are shown. As those skilled in the art would realize, the described embodiments may be modified in various different ways, all without departing from the spirit or scope of the disclosed technology.

In the drawings, the thickness of layers, films, panels, regions, etc., are exaggerated for clarity. Like reference numerals designate like elements throughout the specification. It will be understood that when an element such as a layer, film, region, or substrate is referred to as being "on" another element, it can be directly on the other element or intervening elements may also be present. In contrast, when an element is referred to as being "directly on" another element, there are no intervening elements present.

First, a display device according to an exemplary embodiment of the disclosed technology will be described below with reference to the accompanying drawings.

FIG. 1 is a block diagram illustrating a display device according to an exemplary embodiment of the disclosed technology.

The display device according to an exemplary embodiment of the disclosed technology includes a display panel 300, a gate driver 400, a data driver 500, and the like.

The display panel 300 includes a plurality of gate lines G1-Gn, a plurality of data lines D1-Dm, and a plurality of pixels PX. The pixels PX are connected to the gate lines G1-Gn and the data lines D1-Dm. Meanwhile, the display panel 300 includes a display area DA and a peripheral area PA around the display area DA. The pixels PX are arranged in the display area DA too. The gate lines G1-Gn transfer gate signals and the data lines D1-Dm transfer data signals. Each of the pixels PX includes a switching element connected to one of the gate lines G1-Gn and one of the data lines D1-Dm in addition to a pixel electrode. The switching element may be a three-terminal element such as a thin film transistor which is integrated on the display panel 300.

The gate driver 400 is connected with the gate lines G1-Gn to sequentially transfer gate signals. The gate signal includes a gate-on voltage Von and a gate-off voltage Voff. The gate driver 400 receives a scanning start signal STV instructing output start of a gate-on pulse, a gate clock signal CPV controlling an output timing of the gate-on pulse, clock signals CK and CKB, and the like, in order to sequentially drive the gate lines G1-Gn. The signal lines for applying the signals to the gate driver 400 may be disposed in the peripheral area PA of the display panel 300.

The gate driver 400 may be directly installed in the peripheral area PA of the display panel 300 and integrated in the peripheral area PA during the same manufacturing process as the switching element including the pixel PX.

The data driver 500 is connected with the data lines D1-Dm to transfer data signals. The data signals are constituted by data voltages representing a plurality of grays. The data driver 500 receives a plurality of voltages in order to generate the data signals. The voltage lines for applying the voltages may be disposed in the peripheral area PA of the display panel 300.

The data driver 500 may be directly installed in the peripheral area PA of the display panel 300, and integrated in the peripheral area PA during the same manufacturing process as the switching element including the pixel PX.

The display device according to an exemplary embodiment of the disclosed technology further includes a printed circuit board 700 which supplies voltages applied to the gate driver 400 and the data driver 500.

Further, the display device further includes a connecting member 600 by which the printed circuit board 700 is fixed to the display panel 300. The connecting member 600 may be made of film on glass (FOG).

Hereinafter, a connection relationship between the data driver 500 and the printed circuit board 700 and voltages transferred to the data driver 500 will be described with reference to drawings.

Figure 2:
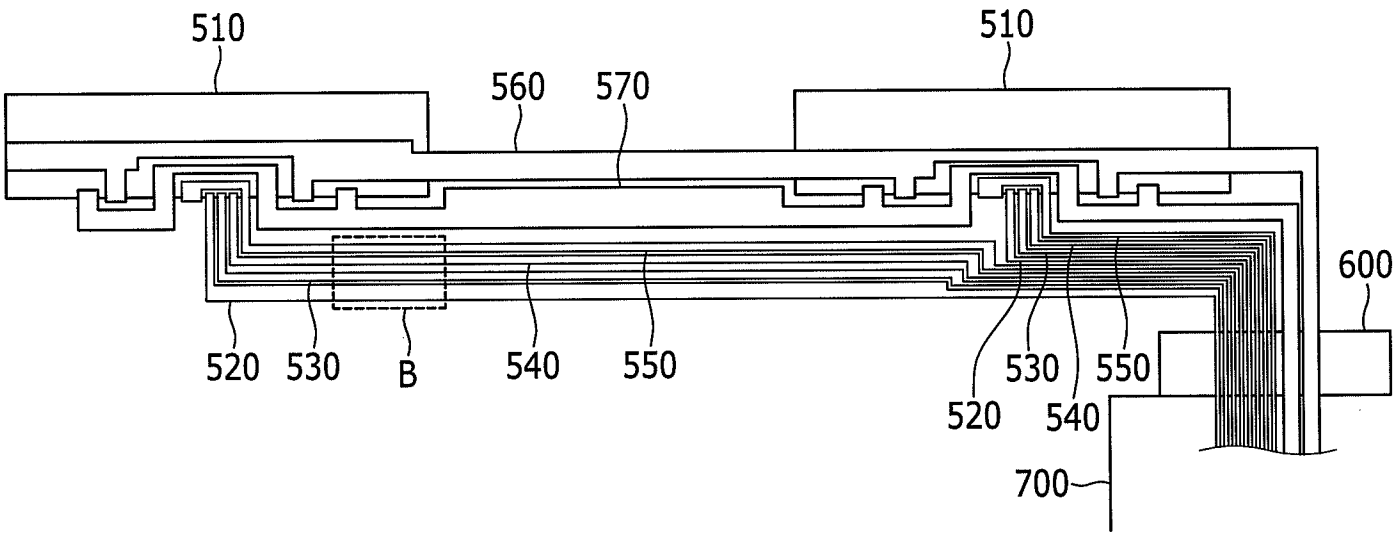
FIG. 2 is a plan view illustrating a part of the display device according to the exemplary embodiment of the disclosed technology by enlarging a portion A of FIG. 1.

FIG. 2 is a plan view illustrating a part of the display device according to an exemplary embodiment of the disclosed technology by enlarging a portion A of FIG. 1. Particularly, constituent elements formed in the peripheral area of the display panel are illustrated.

As illustrated in FIG. 2, a plurality of voltage lines 520, 530, 540, 550, 560 and 570 which connect the data driver 500 and the printed circuit board 700 are formed in the peripheral area of the display panel.

The data driver 500 includes a plurality of data driving ICs 510, and the voltage lines 520, 530, 540, 550, 560, and 570 connecting the data driving ICs 510 and the printed circuit board 700.

The voltage lines 520, 530, 540, 550, 560 and 570 are configured by a first voltage line 520, a second voltage line 530, a third voltage line 540, and a fourth voltage line 550 to transfer an analog power voltage. They are configured by a fifth voltage line 560 and a sixth voltage line 570 to transfer a logic power voltage.

The first to fourth voltages lines 520, 530, 540 and 550 transferring the analog power voltage connect the data driving ICs 510 with the printed circuit board 700 by a point-to-point method. In an exemplary implementation, the first to fourth voltages lines 520, 530, 540 and 550 connecting a first one of the data driving ICs 510 to the printed circuit board 700, and the first to fourth voltages lines 520, 530, 540, and 550 connecting a second one of the data driving ICs 510 to the printed circuit board 700 are separately formed. Since the analog power voltage is directly associated with a recognition characteristic of the panel, in order to reduce a deviation among the data driving ICs 510, the data driving ICs 510 and the printed circuit board 700 are connected with each other by a point-to-point method. In this case, line widths of the first to fourth voltage lines 520, 530, 540 and 550 connected to the data driving ICs 510 which are close to the printed circuit board 700 may be smaller than line widths of the first to fourth voltage lines 520, 530, 540 and 550 connected with the data driving ICs 510 which are far away from the printed circuit board 700.

The fifth and sixth voltage lines 560 and 570 transferring the logic power voltage connect the data driving ICs 510 to the printed circuit board 700 by a cascade method. In an exemplary implementation, the fifth and sixth voltage lines 560 and 570 connecting the second data driving IC 510 and the printed circuit board 700 are extended to connect to the first one of the data driving ICs 510. That is, one fifth voltage line 560 and one sixth voltage line 570 connect to the second data driving IC 510 and the first data driving IC 510 to the printed circuit board 700. In the case of the logic power voltage, since only a voltage, which, may ensure a frequency margin and a frequency characteristic, needs to be maintained, the fifth and sixth voltage lines 560 and 570 connect the data driving ICs 510 to the printed circuit board 700 by the cascade method, by considering space efficiency.

The first voltage line 520 transfers the first power voltage from the printed circuit board 700 to the data driving ICs 510. The first power voltage may be an analog driving voltage AVDD. In an exemplary implementation, the first power voltage may be 8 V.

The second voltage line 530 transfers at least one of the first power voltage and the second power voltage from the printed circuit board 700 to the data driving ICs 510. The second power voltage may be a half-AVDD (HAVDD). Accordingly, the first power voltage may be twice of the second power voltage. In an exemplary implementation, the second power voltage is 4 V.

The third voltage line 540 transfers the second power voltage or the third power voltage from the printed circuit board 700 to the data driving IC 510. The third power voltage may be a ground voltage (GND). In an exemplary implementation, the third power voltage may be 0 V.

The fourth voltage line 550 transfers the third power voltage from the printed circuit board 700 to the data driving IC 510.

The fifth voltage line 560 transfers the fourth power voltage from the printed circuit board 700 to the data driving IC 510. In an exemplary implementation, the fourth power voltage may be 1.8 V or 2.5 V.

The sixth voltage line 570 transfers the fifth power voltage from the printed circuit board 700 to the data driving IC 510. The fifth power voltage may be a ground voltage (GND). In an exemplary implementation, the fifth power voltage is 0V.

According to a design structure of the display panel 300, the supply of the second power voltage may or may not be required.

Hereinafter, a voltage supplied by each voltage line according to the supply of the second power voltage will be described below with reference to FIGS. 3 and 4.

Figure 3:
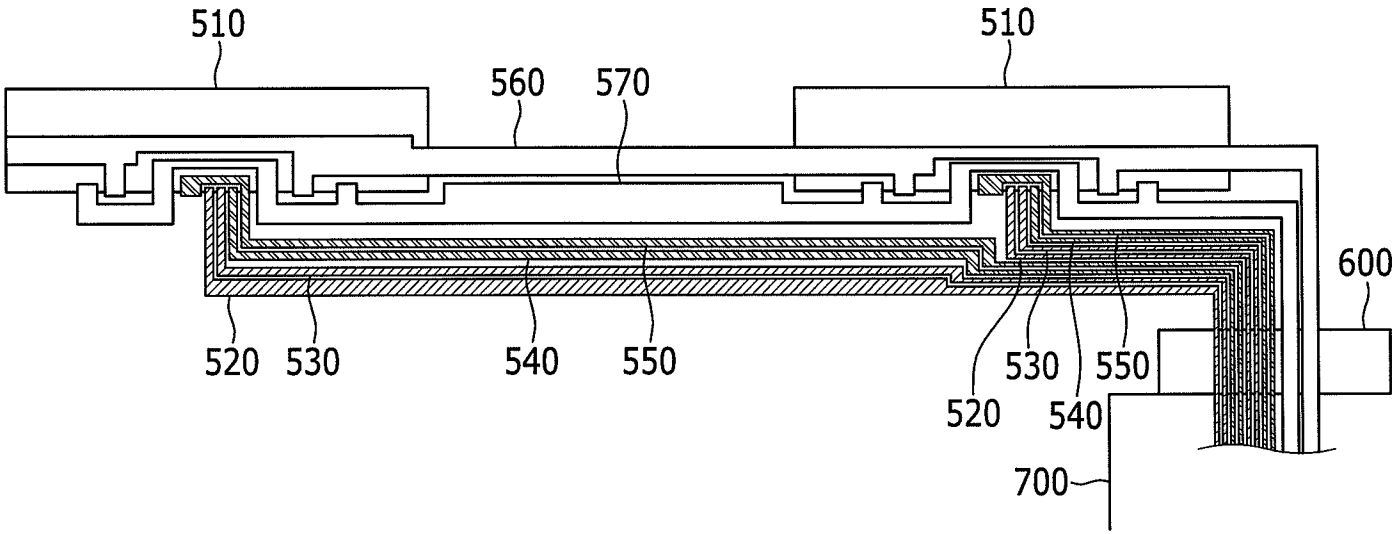
FIG. 3 is a plan view illustrating voltage lines divided according to a voltage applied to each voltage line in the case where supply of a second power voltage is not required in FIG. 2.
Figure 4:
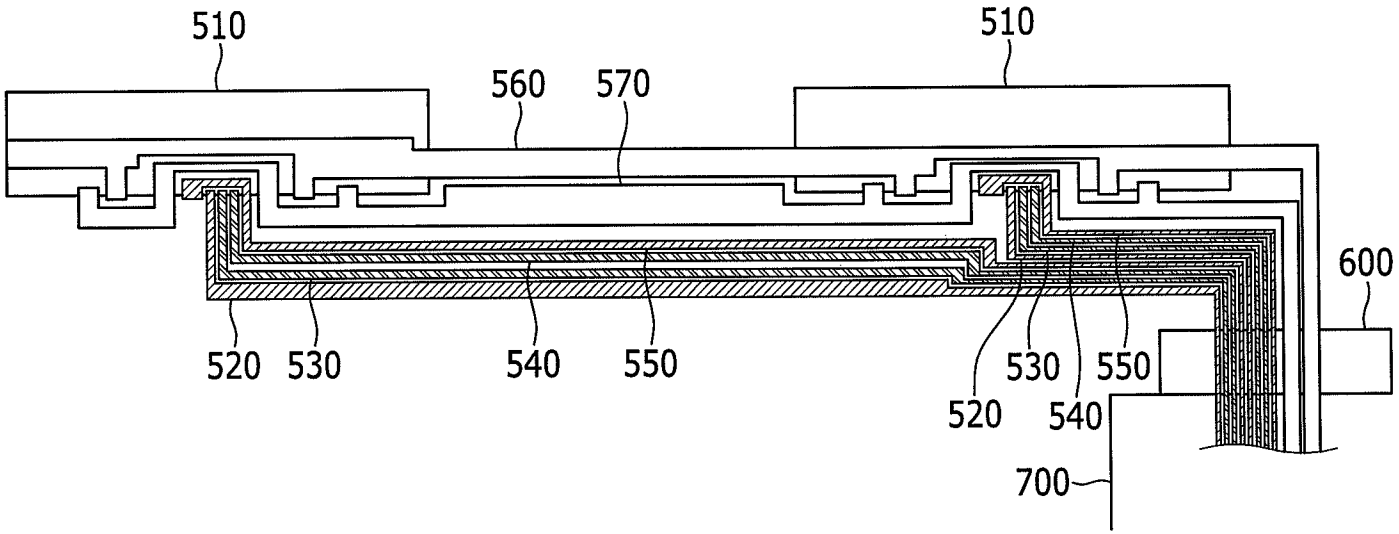
FIG. 4 is a plan view illustrating voltage lines divided according to a voltage applied to each voltage line in the case where supply of a second power voltage is required in FIG. 2.

FIG. 3 is a plan view illustrating voltage lines divided according to a voltage applied to each voltage line in the case where the supply of a second power voltage is not required in FIG. 2, and FIG. 4 is a plan view illustrating voltage lines divided according to a voltage applied to each voltage line in the case where supply of a second power voltage is required in FIG. 2.

In the case where the supply of the second power voltage is not required, as illustrated in FIG. 3, the first voltage line 520 and the second voltage line 530 transfer the first power voltage, and the third voltage line 540 and the fourth voltage line 550 transfer the third power voltage.

In the case where the supply of the second power voltage is required, as illustrated in FIG. 4, the first voltage line 520 transfers the first power voltage, the second voltage line 530 and the third voltage line 540 transfer the second power voltage, and the fourth voltage line 550 transfers the third power voltage.

Regardless of the supply of the second power voltage, the first voltage line 520 transfers the first power voltage, and the fourth voltage line 550 transfers the third power voltage. In the case where the supply of the second power voltage is required, the second voltage line 530 and the third voltage line 540 supply the second power voltage, and in the case where the supply of the second power voltage is not required, the second voltage line 530 and the third voltage line 540 are used to transfer the first power voltage and the third power voltage, respectively.

Accordingly, regardless of a need for the supply of the second power voltage, the voltage lines 520, 530, 540, 550, 560 and 570 connecting the data driver 500 and the printed circuit board 700 will be designed to have the same sizes and resistance.

Hereinafter, widths of the first voltage line 520, the second voltage line 530, the third voltage line 540 and the fourth voltage line 550 will be described below with reference to FIG. 5.

Figure 5:
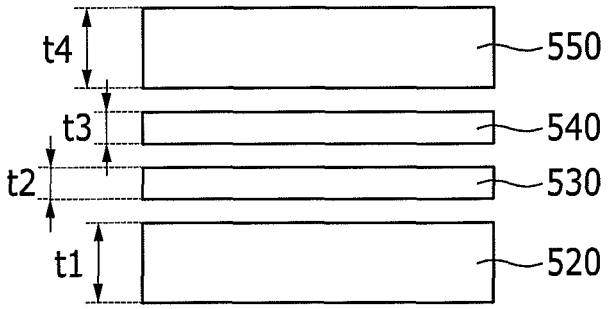
FIG. 5 is a plan view illustrating first to fourth voltage lines by enlarging a portion B of FIG. 2.

FIG. 5 is a plan view illustrating first to fourth voltage lines by enlarging a portion B of FIG. 2.

A width t1 of the first voltage line 520 is equal to a width t4 of the fourth voltage line 550. By equalizing wire resistances of the first voltage line 520 and the fourth voltage line 550, an amount of a drop of the first power voltage transferred through the first voltage line 520 is equal to an amount of a drop of the third power voltage transferred through the fourth voltage line 550.

In one exemplary implementation, the width t1 of the first voltage line 520 is equal to a sum of a width t2 of the second voltage line 530 and a width t3 of the third voltage line 540. As a result, the wire resistance of the first voltage line 520 is configured by a sum of a wire resistance of the second voltage line 530 and a wire resistance of the third voltage line 540. When the second power voltage is transferred through the second voltage line 530 and the third voltage line 540, an amount of a drop of the first power voltage transferred through the first voltage line 520 is equal to an amount of a drop of the second power voltage transferred through the second voltage line 530 and the third voltage line 540.

Since the width t1 of the first voltage line 520 is equal to a width t4 of the fourth voltage line 550, the width t4 of the fourth voltage line 550 is equal to a sum of the width t2 of the second voltage line 530 and the width t3 of the third voltage line 540. As a result, a wire resistance of the fourth voltage line 550 is configured by a sum of the wire resistance of the second voltage line 530 and the wire resistance of the third voltage line 540. When the second power voltage is transferred through the second voltage line 530 and the third voltage line 540, an amount of a drop of the third power voltage transferred through the fourth voltage line 550 is equal to an amount of a drop of the second power voltage transferred through the second voltage line 530 and the third voltage line 540.

That is, the width t1 of the first voltage line 520 and the width t4 of the fourth voltage line 550 are equal to each other, and the width t1 of the first voltage line 520 is equal to the sum of the width t2 of the second voltage line 530 and the width t3 of the third voltage line 540. And as a result, the amounts of the first power voltage drop, the second power voltage drop, and the third power voltage drop are equal to each other.

The width t2 of the second voltage line 530 is equal to the width t3 of the third voltage line 540. The wire resistances of the second voltage line 530 and the third voltage line 540 become equal to each other. Accordingly, when the first power voltage is transferred through the second voltage line 530 and the third power voltage is transferred through the third voltage line 540, an amount of a drop of the first power voltage transferred through the second voltage line 530 is equal to an amount of a drop of the third power voltage transferred through the third voltage line 540.

Hereinafter, referring to FIG. 6, wire resistances of voltage lines in the display devices according to a Comparative Example which forms a separate wire for transferring only the second power voltage and the exemplary embodiment of the disclosed technology will be compared with each other.

Figure 6:
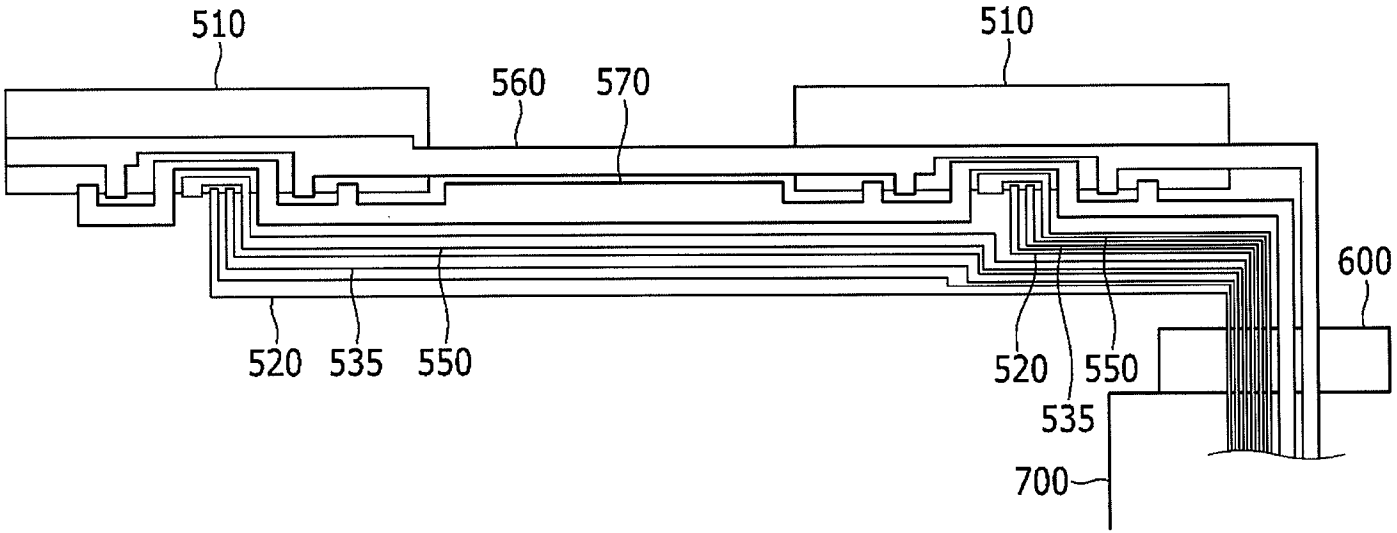
FIG. 6 is a plan view illustrating a part of a display device according to a Comparative Example.

FIG. 6 is a plan view illustrating a part of a display device according to a Comparative Example.

In the Comparative Example disclosed for comparison with the exemplary embodiment of the disclosed technology, a plurality of voltage lines 520, 535, 550, 560, and 570 connecting the data driving IC 510 and the printed circuit board 700 is formed.

The voltage lines 520, 535, 550, 560 and 570 are configured by a first voltage line 520, a seventh voltage line 535, and a fourth voltage line 550 to transfer an analog power voltage. The voltage lines 520, 535, 550, 560 and 570 are configured by a fifth voltage line 560 and a sixth voltage line 570 to transfer a logic power voltage.

In the case where the supply of the second power voltage is required, the first voltage line 520 transfers a first power voltage, the seventh voltage line 535 transfers a second power voltage, and the fourth voltage line 550 transfers a third power voltage.

In the case where the supply of the second power voltage is not required, the first voltage line 520 transfers the first power voltage, the fourth voltage line 550 transfer the third power voltage, and the seventh voltage line 535 is not used. Accordingly, the seventh voltage line 535 unnecessarily occupies a space.

Hereinafter, referring to Table 1 and Table 2, the wire resistances of the voltage lines in the display devices according to the Comparative Example and the exemplary embodiment of the disclosed technology will be compared with each other.

Table 1 is a table illustrating widths, resistances, and voltage drop amounts of wires transferring the first to third power voltages in the Comparative Example, and Table 2 is a table illustrating widths, resistances, and voltage drop amounts of wires transferring the first to third power voltages in the exemplary embodiment of the disclosed technology.

The wire resistance represents a resistance value of each voltage line itself, a total resistance represents a resistance value obtained by adding a contact resistance between each voltage line and a data driving IC and a wire resistance.

TABLE 1

| | When second power voltage is applied | | | | When second power voltage is not applied | | | |
|---|---|---|---|---|---|---|---|---|
| | First power voltage | Second power voltage | Third power voltage | Total | First power voltage | Second power voltage | Third power voltage | Total |
| Wire width (ratio) | 4.33 | 4.33 | 4.33 | 15 | 4.33 | — | 4.33 | 15 |
| Wire resistance (Ω) | 8.08 | 8.08 | 8.08 | — | 8.08 | — | 8.08 | — |
| Total resistance (Ω) | 9.08 | 9.08 | 9.08 | — | 9.08 | — | 9.08 | — |
| Voltage drop amount (mV) | 181.6 | 181.6 | 181.6 | 363.2 | 181.6 | — | 181.6 | 363.2 |

TABLE 2

| | When second power voltage is applied | | | | When second power voltage is not applied | | | |
|---|---|---|---|---|---|---|---|---|
| | First power voltage | Second power voltage | Third power voltage | Total | First power voltage | Second power voltage | Third power voltage | Total |
| Wire width (ratio) | 4 | 4 | 4 | 15 | 6 | — | 6 | 15 |

TABLE 2-continued

| | When second power voltage is applied | | | | When second power voltage is not applied | | | |
|---|---|---|---|---|---|---|---|---|
| | First power voltage | Second power voltage | Third power voltage | Total | First power voltage | Second power voltage | Third power voltage | Total |
| Wire resistance (Ω) | 8.75 | 8.75 | 8.75 | — | 5.83 | — | 5.83 | — |
| Total resistance (Ω) | 9.75 | 9.75 | 9.75 | — | 6.5 | — | 6.5 | — |
| Voltage drop amount (mV) | 195 | 195 | 195 | 390 | 130 | — | 130 | 260 |

As illustrated in Table 1 and Table 2, when the second power voltage is applied, in the exemplary embodiment of the disclosed technology, the voltage drop amounts increase, as compared with the Comparative Example. However, an increase in the voltage drop amount is not large, and as a result, the data driver 500 may be normally driven.

When the second power voltage is not applied, in the exemplary embodiment of the disclosed technology, the voltage drop amounts largely decrease, as compared with the Comparative Example. In the exemplary embodiment of the disclosed technology, when the second power voltage is not applied, the second voltage line 530 and the third voltage line 540 are used. As a result, the voltage drop which occurs in the wires transferring the first power voltage and the third power voltage is reduced.

Hereinabove, the case where the first power voltage is the analog driving voltage (AVDD), the second power voltage is the half-AVDD (HAVDD), and the third power voltage is the ground voltage (GND) is described, but the disclosed technology is not limited thereto. The disclosed technology may be applied to any case where the number of voltages which are applied through the voltage lines is changed according to a design of the display panel.

In an exemplary implementation, the first power voltage is a first driving voltage, the second power voltage is a common voltage, and the third power voltage is a second driving voltage. In this case, magnitudes of the first power voltage and the third power voltage are the same as each other, and polarities thereof may be opposite to each other. In an exemplary implementation, the first power voltage is 4 V, the second power voltage is 0 V, and the third power voltage are −4 V.

For purposes of summarizing the disclosed technology, certain aspects, advantages and novel features of the disclosed technology have been described herein. It is to be understood that not necessarily all such advantages may be achieved in accordance with any particular embodiment of the disclosed technology. Thus, the disclosed technology may be embodied or carried out in a manner that achieves or optimizes one advantage or group of advantages as taught herein without necessarily achieving other advantages as may be taught or suggested herein.

Various modifications of the above described embodiments will be readily apparent, and the generic principles defined herein may be applied to other embodiments without departing from the spirit or scope of the disclosed technology. Thus, the disclosed technology is not intended to be limited to the embodiments shown herein but is to be accorded the widest scope consistent with the principles and novel features disclosed herein.

What is claimed is:

1. A display device, comprising:

a display panel;

a data driver formed on the display panel;

a printed circuit board configured to supply a voltage to the data driver; and a plurality of voltage lines connecting the data driver to the printed circuit board, wherein the voltage lines include a first voltage line configured to transfer a first power voltage, a second voltage line configured to transfer at least one of the first power voltage and a second power voltage, the second power voltage being lower than the first power voltage, a third voltage line configured to transfer at least one of the second power voltage and a third power voltage, the third power voltage being lower than the second power voltage, and a fourth voltage line configured to transfer the third power voltage, wherein the third voltage line is further configured to transfer the third power voltage when the second voltage line transfers the first power voltage.

2. The display device of claim 1, wherein the third voltage line transfers the second power voltage when the second voltage line transfers the second power voltage.

3. The display device of claim 2, wherein the width of the first voltage line is substantially equal to that of the fourth voltage line.

4. The display device of claim 3, wherein the width of the first voltage line is substantially equal to the sum of the width of the second voltage line and the width of the third voltage line.

5. The display device of claim 4, wherein the width of the second voltage line is substantially equal to that of the third voltage line.

6. The display device of claim 5, wherein the first power voltage is twice of the second power voltage, and wherein the third power voltage is a ground voltage.

7. The display device of claim 1, wherein the width of the first voltage line is substantially equal to that of the fourth voltage line.

8. The display device of claim 7, wherein the width of the first voltage line is substantially equal to the sum of the width of the second voltage line and the width of the third voltage line.

9. The display device of claim 8, wherein the width of the second voltage line is substantially equal to that of the third voltage line.

10. The display device of claim 1, wherein the first power voltage is twice of the second power voltage, and wherein the third power voltage is a ground voltage.

11. The display device of claim 1, wherein the data driver includes a plurality of data driving integrated circuits (ICs), and wherein the voltage lines connect the data driving ICs and the printed circuit board.

12. The display device of claim 11, wherein the voltage lines include a plurality of first voltage lines, a plurality of second voltage lines, a plurality of third voltage lines, and a plurality of fourth voltage lines, and wherein the first voltage lines, the second voltage lines, the third voltage lines, and the fourth voltage lines connect the data driving ICs to the printed circuit board by a point-to-point method.

13. The display device of claim 12, wherein the voltage lines further include:

a fifth voltage line transferring a fourth power voltage, and a sixth voltage line transferring a fifth power voltage, and wherein the fifth voltage line and the sixth voltage line connect the data driving ICs with the printed circuit board by a cascade method.

14. The display device of claim 13, wherein the first voltage line, the second voltage line, the third voltage line, and the fourth voltage line transfer analog power voltages, and wherein the fifth voltage line and the sixth voltage line transfer logic power voltages.

15. The display device of claim 1, further comprising a connecting member fixing the printed circuit board to the display panel, wherein the connecting member is made of film on glass (FOG).

16. The display device of claim 1, further comprising a gate driver formed on the display panel.

17. The display device of claim 1, wherein the second power voltage is a common voltage.

18. The display device of claim 17, wherein a magnitude of the first power voltage is substantially equal to that of the third power voltage, and wherein a polarity of the first power voltage is opposite to that of the third power voltage.

* * * * *